US006695143B2

(12) United States Patent
Alm et al.

(10) Patent No.: US 6,695,143 B2
(45) Date of Patent: Feb. 24, 2004

(54) PILFER-PROOF PACKAGE

(75) Inventors: Sture Alm, Lidköping (SE); Tord Englund, Edsbyn (SE); Staffan Lindberg, Edsbyn (SE)

(73) Assignee: Kanthal AB, Sandviken (SE)

( * ) Notice: Subject to any disclaimer, the term of this patent is extended or adjusted under 35 U.S.C. 154(b) by 0 days.

(21) Appl. No.: 10/168,688

(22) PCT Filed: Dec. 21, 2000

(86) PCT No.: PCT/SE00/02637

§ 371 (c)(1),
(2), (4) Date: Oct. 3, 2002

(87) PCT Pub. No.: WO01/46036

PCT Pub. Date: Jun. 28, 2001

(65) Prior Publication Data

US 2003/0075471 A1 Apr. 24, 2003

(30) Foreign Application Priority Data

Dec. 21, 1999 (SE) ..... 9904707

(51) Int. Cl.[7] ..... B65D 73/00
(52) U.S. Cl. ..... 206/464; 206/468; 206/806
(58) Field of Search ..... 206/461, 464, 206/465, 467, 468, 806, 349, 372

(56) References Cited

U.S. PATENT DOCUMENTS 2,775,366 A 12/1956 Willhelm
4,981,212 A 1/1991 Lutz et al.
5,040,680 A 8/1991 Wilson et al.
5,669,501 A * 9/1997 Hissong et al. ..... 206/438
5,850,916 A 12/1998 Pettersson et al.

FOREIGN PATENT DOCUMENTS

| | | |
|---|---|---|
| DE | 19 52 531 | 5/1971 |
| DE | 31 13 809 | 10/1982 |
| SE | 463 607 | 12/1990 |
| SE | 504 665 | 3/1997 |

* cited by examiner

*Primary Examiner*—Shian Luong
(74) *Attorney, Agent, or Firm*—Burns, Doane, Swecker & Mathis, LLP

(57) ABSTRACT

A package for a product includes a base plate on which the product is disposed, and a bridge disposed on the base plate in overlying relationship to a first portion of the product. A lid is disposed in overlying relationship to a second portion of the product and is secured to the base plate by a sliding connection which guides the lid for limited sliding movement parallel to the base plate to expose the second portion of the product. The sliding connection constrains the lid against dislodgment from the base plate in a direction perpendicular to the base plate. An intermediate plate is disposed between the base plate and the lid and is arranged to prevent the sliding movement of the lid. The intermediate plate is formed of a tearable material, such as cardboard, wherein tearing of the intermediate plate releases the lid for the sliding movement.

14 Claims, 1 Drawing Sheet

PILFER-PROOF PACKAGE

BACKGROUND

For many products sold in retail stores, it is desirable to provide a package which at the same time allows a customer to touch the product and clearly shows if the packaging has been opened. In this way it is possible to verify, as an example, that a tool is still unused, and in case where several tools are traditionally packaged together that their number has not been reduced by pilfering. One such case is for sawblades, where an easily opened traditional package would make it possible to remove a few sawblades unnoticeably.

Packages of the desired type are known from Swedish Patent 463,607, which shows a package where before the package can be opened a protective flap has to be torn away which was originally made integral with the remaining parts of the package. This package has the disadvantage that it might be difficult to tear away the protective flap if the package is made from such a resistant material that would be desirable for the continued use of it, and that the flap is so small that it is not clearly noticeable when it is missing.

The present invention concerns a package which will expose elongated products with a certain variation in length and prevent any of them from being removed without this being clearly noticeable, and which can be used as a protective package for the products in connection with their storage and future use.

BRIEF DESCRIPTION OF THE DRAWINGS

The invention is described with reference to the figures, where.

SUMMARY OF THE INVENTION

Figure 1:
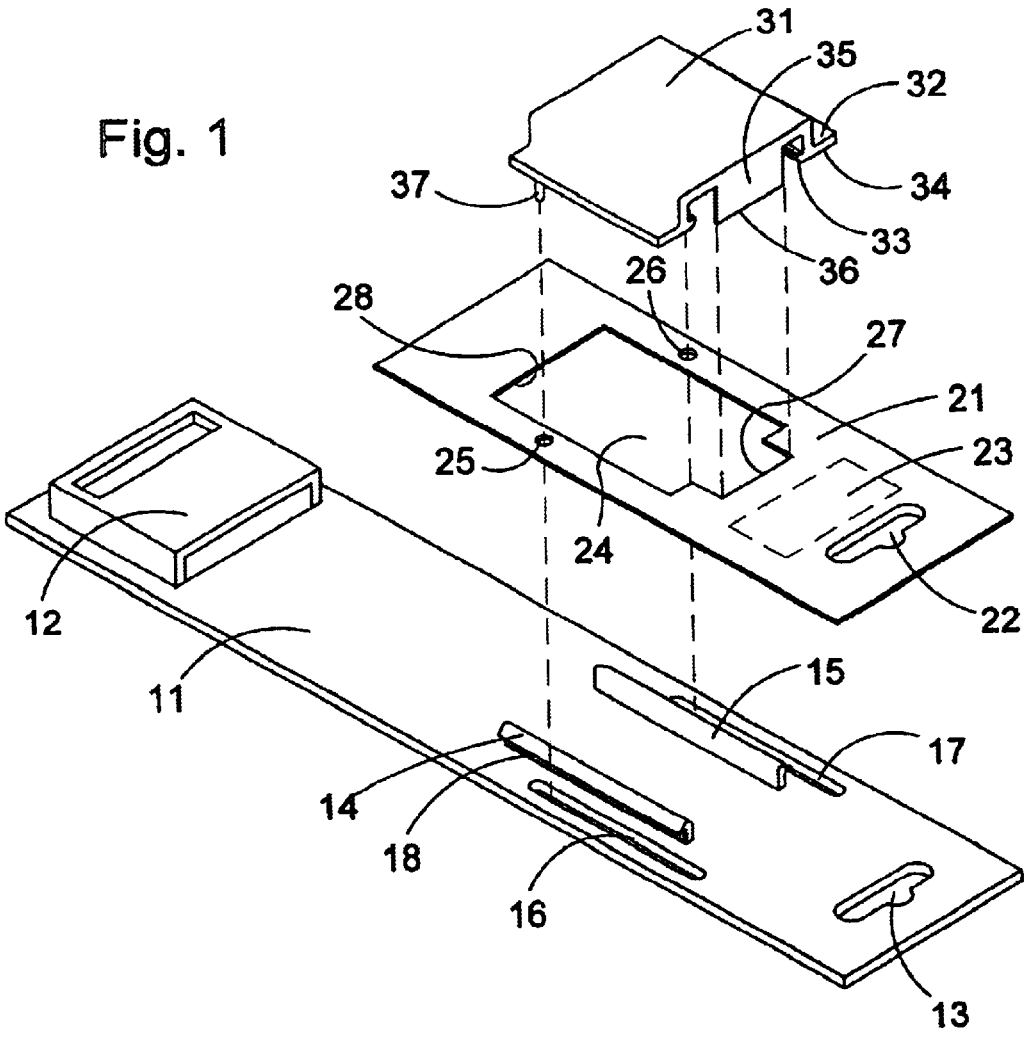
FIG. 1 is an exploded view of the three components of the package.
Figure 2:
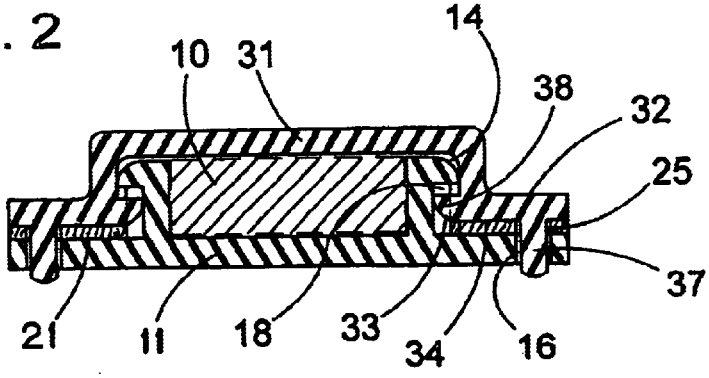
FIG. 2 depicts a cross-section through an assembled package.

The invention pertains to a package for a product, the package including a base plate on which the product is disposed, and a bridge disposed on the base plate in overlying relationship to a first portion of the product. A lid is disposed in overlying relationship to a second portion of the product and is secured to the base plate by a sliding connection which guides the lid for limited sliding movement parallel to the base plate to expose the second portion of the product. The sliding connection constrains the lid against dislodgement from the base plate in a direction perpendicular to the base plate. An intermediate plate is disposed between the base plate and the lid and is arranged to prevent the sliding movement of the lid. The intermediate plate is formed of a tearable material, wherein tearing of the intermediate plate releases the lid for the sliding movement.

DETAILED DESCRIPTION OF A PREFERRED EMBODIMENT OF THE INVENTION

The package comprises a base plate (11) which at its lower end has a bridge (12) which encloses and prevents detachment of the lower end of the products. At the upper end the base plate is provided with a suspension hole (13) for suspending the package on a wall or display stand. Below the suspension hole the base plate is provided with two elevated rails (14,15) with top heads having a forwardly facing sloping surface. Between the rails and the edges of the base plate there is provided one slot (16,17) on each side. On the side (18) facing the slots the rails are provided with a high friction surface, such as rough or corrugated. The base plate (11) is made from a stiff thermoplastic polymer.

The package comprises an intermediate plate (21) made from a material with lower strength, such as cardboard. The intermediate plate is provided with a cutout (24), the length of which between its end contours (27,28) corresponds to the length of the rails (14,15) of the base plate. On each side of the cutout there is a hole (25,26). At the upper end of the intermediate plate there is a suspension hole (22) similar to the suspension hole (13) in the base plate. Between the suspension hole and the cutout (24) there is space (23) for information about the product and its package. If desired, the intermediate plate can be made so long that it approaches the lower end of the base plate with the bridge (12).

The package comprises a lid (31) which on two sides has sliders (32) and at its upper end has a tongue (35). Each slider has a bottom head having a rearwardly facing sloping surface (33) and an adjoining a high friction face (38) with rough or corrugated surface that is in contact with the corresponding side surface (18) of the rail (14) on the base plate. From the underside (34) of each slider extends a peg (37) the length of which corresponds to the sum of thicknesses of the base plate and the intermediate plate, or slightly more. The length of the tongue (35) should be such that its lower edge (36) is located as far below the bottom (34) of the sliders as corresponds to the thickness of the intermediate plate. The lid is likewise preferably made from a stiff thermoplastic polymer.

When a product is to be enclosed in the package, the intermediate plate is placed on top of the base plate with the rails (14,15) extending through the cutout (24). The product is then laid with its lower end extending under the bridge (12) and its upper end (10) between the rails (14,15) of the base plate. The lid (31) is then placed above the cutout (24) and pressed down, whereby the sloping surfaces (33) of the lid slide against the sloping surfaces of the rails (14,15) to press the rails elastically together until the lid can be snapped down to contact the intermediate plate. The rails then spring back to their original distance and the friction surfaces (38) of the lid sliders contact the friction surfaces (18) of the rails. The pegs (37) penetrate the holes (25,26) of the intermediate plate and the slots (16,17) of the base plate. The tongue (35) penetrates the cutout (24) close to its end contour (27) until the lower edge (36) contacts the base plate. The tongue can then restrict longitudinal displacement of the product.

The same base plate and lid can be used for products of a different length by providing the intermediate plate with holes (25,26) and spacing the upper end contour (27) at a different distance from the lower end contour (28) which will locate the lid (31) at a different position relative to the rails (14,15) during assembly.

Since the sloping surfaces of the rails (14) after springback extend over the friction surfaces (38) of the sliders, the lid can not be lifted off. Nor can the lid be slid io off in the longitudinal direction of the package, since the pegs (37) as well as the tongue (35) are constrained by the intermediate plate at the holes (25,26) and the cutout end contour (27).

When the buyer wants to unpack the product to use it, he can tear the intermediate plate apart into pieces at the holes (25,26) and remove the pieces, or at least the upper piece. The tongue (35) of the lid is then freely movable with the lower edge (36) slidable against the base plate, and the pegs (37) movable within the slots (16,17). The lid can then be slid in the longitudinal direction with a force determined by the friction surfaces for a distance determined by the mobility of the pegs (37) in the slots (16,17). The distance should be chosen long enough to make it possible to release the product. However, the lid can still not be removed from the base plate.

In this way, the product or products can be protected in the package even after it has been opened, but it is not possible to open the package a first time without removing or damaging the intermediate plate. Removing the intermediate plate is very clearly noticeable, since it is made from a different material than the base plate and can be provided with colour print.

In spite of allowing the products to be inspected and touched, the package provides protection after it has been opened, and it can be used for future storage of the products. The width and stiff material of the base plate prevent damage of or by the products during storage, such as in a tool box.

What is claimed is:

1. A package for a product, comprising:

a base plate on which the product is disposed;

a bridge disposed on the base plate in overlying relationship to a first portion of the product;

a lid disposed in overlying relationship to a second portion of the product and secured to the baseplate by a sliding connection which guides the lid for limited sliding movement parallel to the base plate to expose the second portion of the product, the sliding connection constraining the lid against dislodgement from the baseplate in a direction perpendicular to the base plate; and an intermediate plate disposed between the base plate and the lid and arranged to prevent the sliding movement of the lid, the intermediate plate being formed of a tearable material, wherein tearing of the intermediate plate releases the lid for the sliding movement.

2. The package according to claim 1 wherein the intermediate plate is formed of a paperous material.

3. The package according to claim 2 wherein the paperous material is cardboard.

4. The package according to claim 1 wherein the base plate includes a pair of upwardly protruding rails extending parallel to the direction of sliding movement, the lid including a pair of downwardly protruding sliders arranged adjacent respective ones of the rails, each slider including a portion of underlying a portion of the adjacent rail, the rails and sliders defining the sliding connection.

5. The package according to claim 4 wherein the intermediate plate includes a recess through which the rails project.

6. The package according to claim 5 wherein the intermediate plate is restrained against sliding movement relative to the base plate by contact with the rails.

7. The package according to claim 6 wherein the intermediate plate has at least one hole through which pegs of the lid downwardly project to prevent the sliding movement of the lid, the pegs disposed in a slot formed in the base plate parallel to the direction of sliding movement.

8. The package according to claim 7 wherein the slots are dimensioned to prevent sufficient sliding of the lid relative to the base plate to permit removal of the lid from the base plate in a direction perpendicular to the base plate.

9. The package according to claim 4 wherein each of the rails includes a top head having an upwardly facing sloping surface, and each of the sliders including a bottom head having a downwardly facing sloping surface to enable the heads of the sliders to be pushed downwardly past the heads of the rails.

10. The package according to claim 9 wherein each rail includes a high-friction surface engaging the respective bottom head for frictionally opposing the sliding movement.

11. The package according to claim 1 wherein the intermediate plate includes a cutout, the lid including a tongue projecting downwardly through the cutout and arranged to engage an edge of the cutout to prevent the sliding movement in one direction.

12. A package for a product, comprising:

a base plate on which the product is disposed, the base plate including a pair of parallel rails extending upwardly, each rail including a top head having an upwardly facing sloping surface, and a pair of slots extending parallel to the rails;

a bridge disposed on the base plate in overlying relationship to a first portion of the product;

a lid disposed in overlying relationship to a second portion of the product and including a pair of downwardly projecting sliders extending parallel to the rails, each slider including a bottom head having a downwardly facing sloping surface to enable the heads of the sliders to be pushed downwardly past the heads of the rails, the lid further including a pair of pins projecting downwardly into respective ones of the slots; and an intermediate plate disposed between the base plate and the lid and constrained against sliding movement relative to the base plate parallel to the rails, the intermediate plate including holes through which respective ones of the pins extend to prevent the lid from sliding relative to the base plate parallel to the rails, the intermediate plate formed of a tearable material wherein tearing of the intermediate plate releases the lid for the sliding movement.

13. The package according to claim 12 wherein each rail includes a high-friction surface engaging a respective bottom head for frictionally opposing sliding movement of the lid.

14. The package according to claim 12 wherein the slots are dimensioned to prevent the lid from sliding sufficiently far to be removed from the base plate perpendicularly to the base plate.

* * * * *